US009149734B1

(12) United States Patent
Edwards et al.

(10) Patent No.: US 9,149,734 B1
(45) Date of Patent: Oct. 6, 2015

(54) TOY BARBER SHOP ASSEMBLY

(71) Applicants: Bryan Edwards, Akron, OH (US); Crystal Edwards, Akron, OH (US)

(72) Inventors: Bryan Edwards, Akron, OH (US); Crystal Edwards, Akron, OH (US)

( * ) Notice: Subject to any disclaimer, the term of this patent is extended or adjusted under 35 U.S.C. 154(b) by 0 days.

(21) Appl. No.: 14/142,997

(22) Filed: Dec. 30, 2013

(51) Int. Cl.
*A63H 33/30* (2006.01)
*A63H 3/00* (2006.01)

(52) U.S. Cl.
CPC ..... *A63H 33/30* (2013.01)

(58) Field of Classification Search
CPC ..... A63H 3/00; A63H 3/52; A63H 33/008; A63H 33/42; A47B 83/00; A47B 83/02; A47B 83/04
USPC ..... 446/71–76, 476, 478, 479, 482
See application file for complete search history.

(56) References Cited

U.S. PATENT DOCUMENTS 4,334,384 A * 6/1982 Rogers et al. ..... 446/397
4,342,173 A 8/1982 Otake
4,515,359 A 5/1985 Mariol
D342,295 S 12/1993 Houry et al.
5,401,202 A * 3/1995 Guza et al. ..... 446/476
5,429,432 A * 7/1995 Johnson ..... 312/235.3
5,967,632 A 10/1999 Lamia
6,250,021 B1 * 6/2001 Ferrara, Jr. ..... 52/71
6,659,339 B2 12/2003 Konishi
6,773,326 B2 8/2004 Jarvis
6,964,595 B2 11/2005 Libretti
7,472,455 B2 1/2009 Dolton
8,303,369 B2 * 11/2012 Smith et al. ..... 446/478
2005/0106991 A1 * 5/2005 Marine et al. ..... 446/296

FOREIGN PATENT DOCUMENTS

KR 200361607 1/2002

* cited by examiner

*Primary Examiner* — Kien Nguyen

(57) ABSTRACT

A toy barber shop assembly allows a user to imitate cutting and styling hair within the setting of a simulated barber shop environment. The assembly includes a playhouse having a top wall, a bottom wall and a perimeter wall coupled to and extending between the top wall and the bottom wall. Each of the top wall, the bottom wall and the perimeter wall define an interior of the playhouse. A chair and at least one hairstyling implement are provided and are sized for positioning within the interior of the playhouse.

17 Claims, 4 Drawing Sheets

TOY BARBER SHOP ASSEMBLY

BACKGROUND OF THE DISCLOSURE

Field of the Disclosure

The disclosure relates to toy devices and more particularly pertains to a new toy device for allowing a user to imitate cutting and styling hair within the setting of a simulated barber shop environment.

SUMMARY OF THE DISCLOSURE

An embodiment of the disclosure meets the needs presented above by generally comprising a playhouse having a top wall, a bottom wall and a perimeter wall coupled to and extending between the top wall and the bottom wall. Each of the top wall, the bottom wall and the perimeter wall define an interior of the playhouse. A chair and at least one hairstyling implement are provided and are sized for positioning within the interior of the playhouse.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
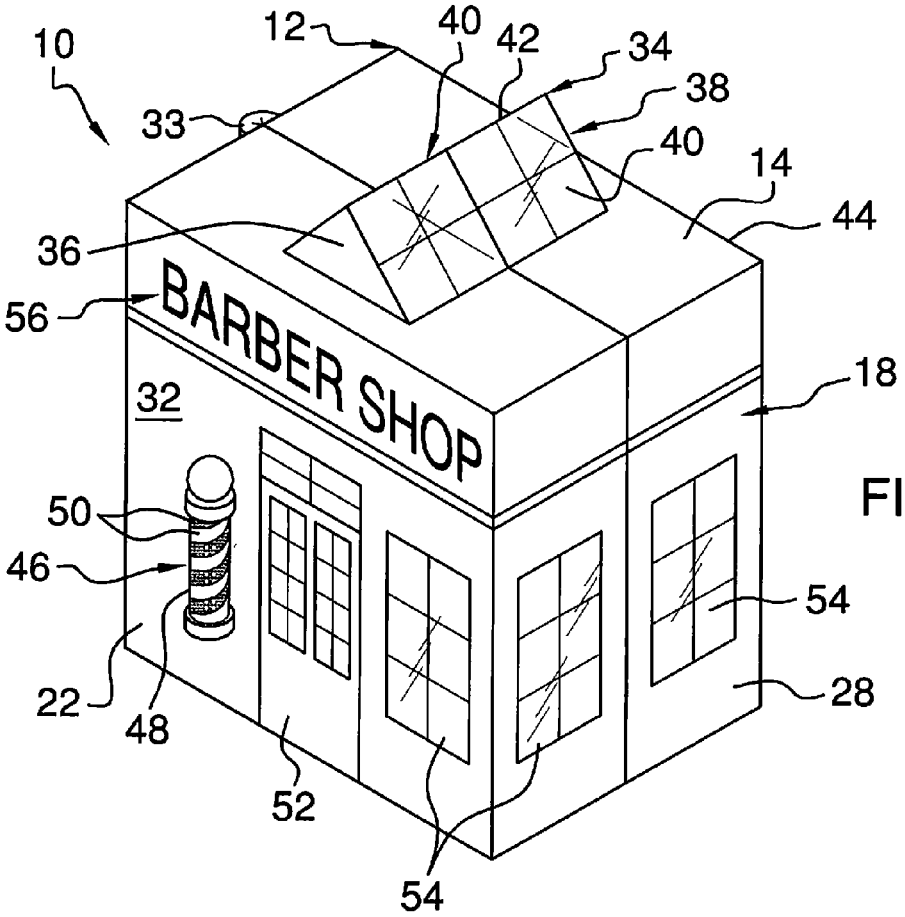
FIG. 1 is a top front side perspective view of a playhouse of a toy barber shop assembly according to an embodiment of the disclosure.
Figure 2:
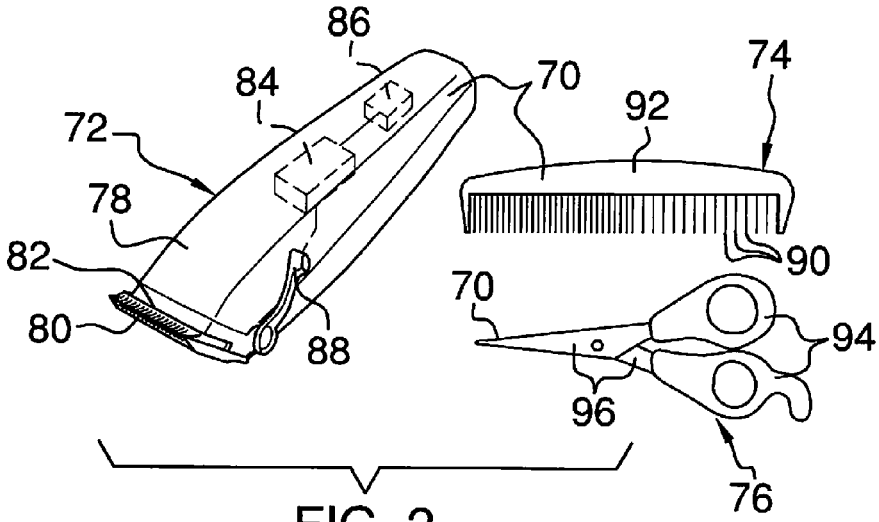
FIG. 2 is a detailed view of a plurality of hair styling implements of an embodiment of the disclosure.
Figure 3:
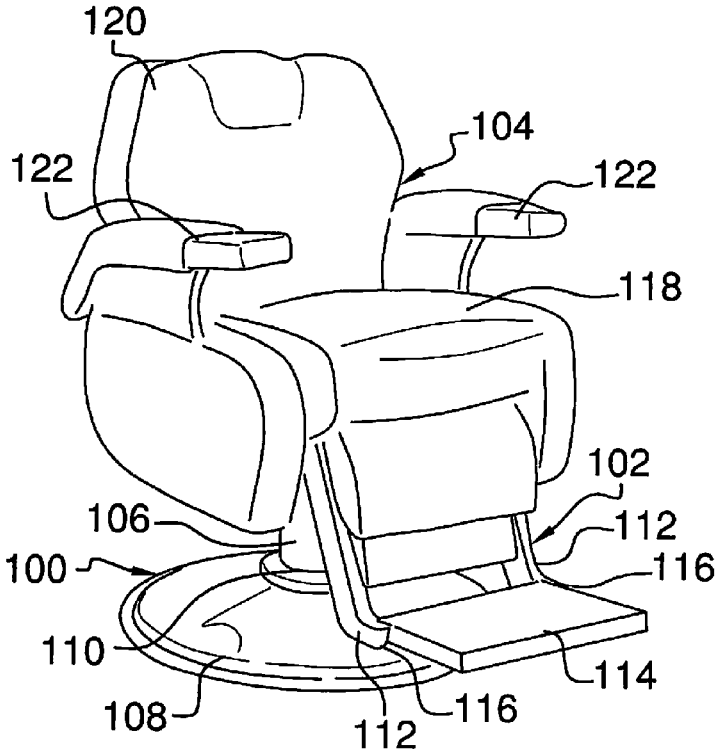
FIG. 3 is a top front side perspective view of a chair of an embodiment of the disclosure.
Figure 4:
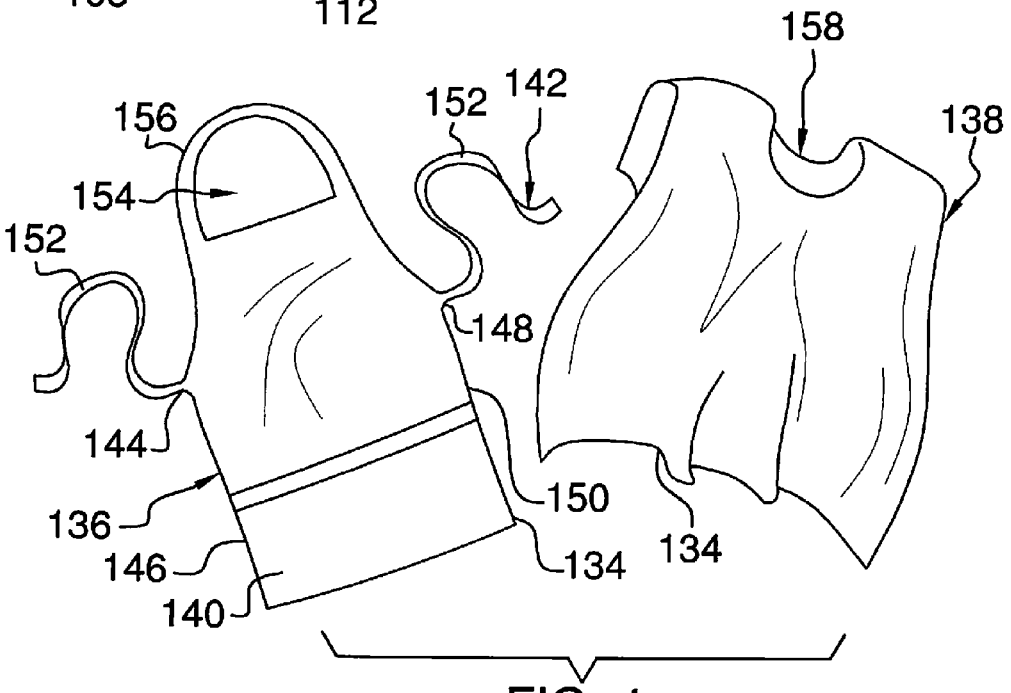
FIG. 4 is a front view of a cape and an apron of an embodiment of the disclosure.
Figure 5:
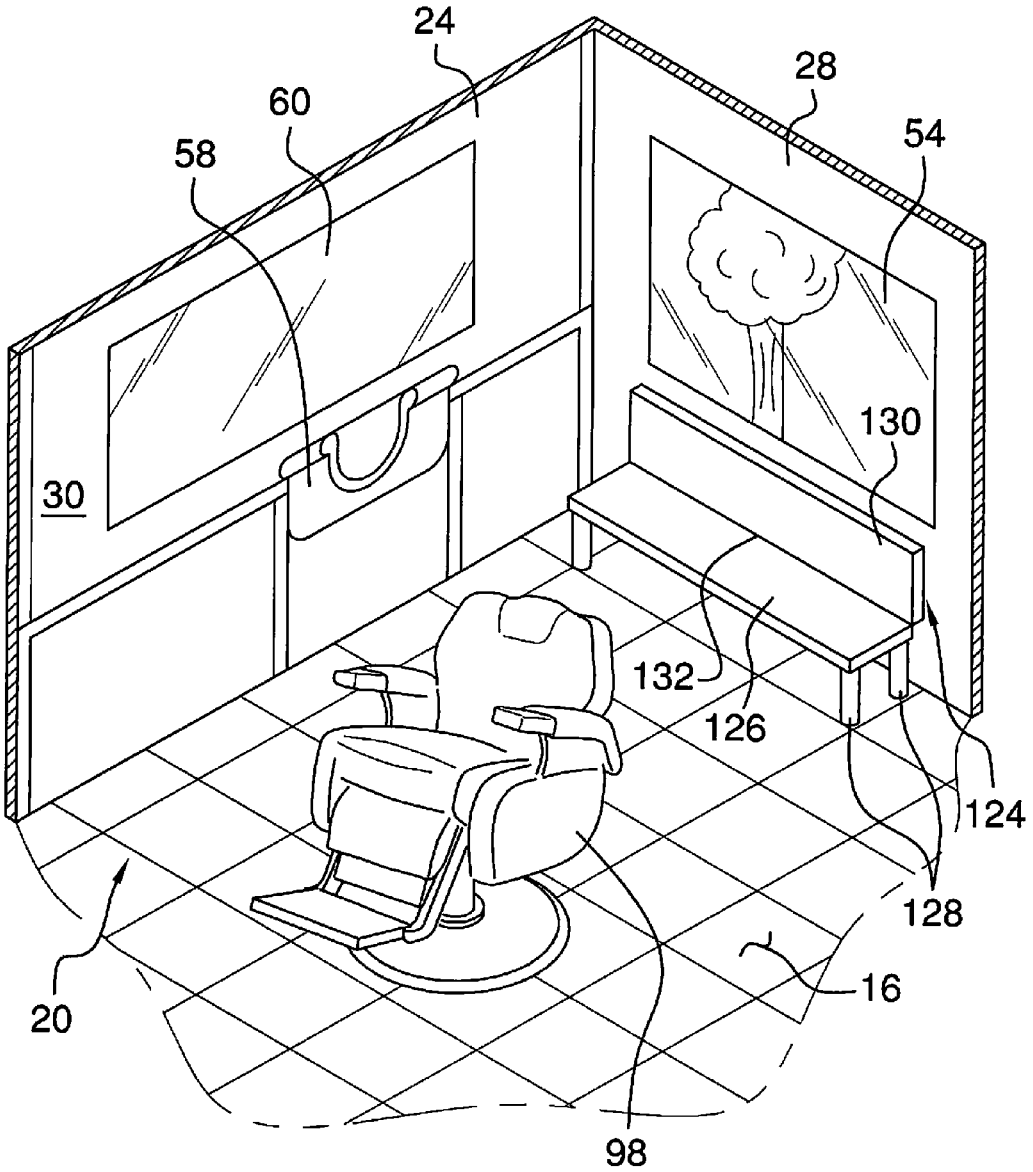
FIG. 5 is a perspective view of an interior of the playhouse of an embodiment of the disclosure.
Figure 6:
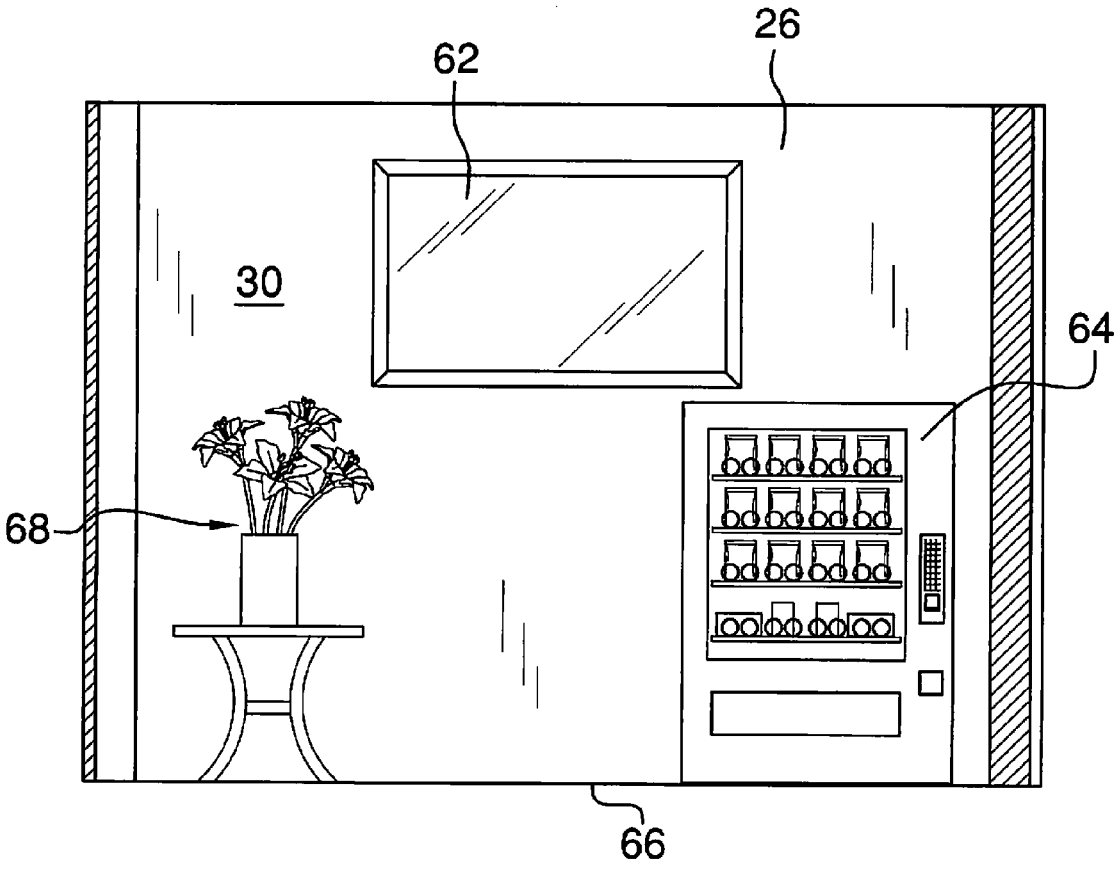
FIG. 6 is a detailed view of an interior of the playhouse showing a first side wall of an embodiment of the disclosure.

With reference now to the drawings, and in particular to FIGS. 1 through 6 thereof, a new toy device embodying the principles and concepts of an embodiment of the disclosure and generally designated by the reference numeral 10 will be described.

As best illustrated in FIGS. 1 through 6, the toy barber shop assembly 10 generally comprises a playhouse 12 having a top wall 14, a bottom wall 16 and a perimeter wall 18 coupled to and extending between the top wall 14 and the bottom wall 16. Each of the top wall 14, the bottom wall 16 and the perimeter wall 18 define an interior 20 of the playhouse 12. The perimeter wall includes a front wall 22, a rear wall 24, a first side wall 26 and a second side wall 28. The playhouse 12 has an interior surface 30 opposite an exterior surface 32. A hinge 33 is coupled to the playhouse 12. The hinge 33 is selectively pivotable to provide access to the interior 20 of the playhouse 12.

A roof 34 is coupled to the exterior surface 32 of the top wall 14. The roof 34 includes a front panel 36, a back panel 38 and a pair of side panels 40 coupled to and extending between the front 36 and back 38 panels. Each of the side panels 40 shares an apex 42 and slants downwardly and outwardly therefrom. The roof 34 may be spaced inwardly from a perimeter edge 44 of the top wall 14. The playhouse 12, including the roof 34, may have a height between approximately 120.0 centimeters and 180.0 centimeters and a width between approximately 120.0 centimeters and 215.0 centimeters. Thus, the assembly 10 will help to realistically simulate a barber shop environment.

Pole indicia 46 is positioned on the exterior surface 32 of the playhouse 12. The pole indicia 46 is configured to resemble a barber pole having a staff 48 with a helix of stripes 50 positioned thereon. Door indicia 52 is positioned on the exterior surface 32 of the playhouse 12. The door indicia 52 is positioned on the perimeter wall 18 of the playhouse 12. The door indicia 52 is configured to resemble a door. A plurality of window indicia 54 positioned on the perimeter wall 18 of the playhouse 12. The window indicia 54 may be positioned on each of the interior surface 30 and the exterior surface 32 of the playhouse 12. Each of the window indicia 54 is configured to resemble a window. Letter indicia 56 is positioned on the exterior surface 32 of the playhouse 12 and may indicate a name of the playhouse 12, such as "Barber Shop" or the like.

Sink indicia 58 is positioned on the interior surface 30 of the playhouse 12. More specifically, the sink indicia 58 is positioned on the perimeter wall 18 and is configured to resemble a salon sink. The sink indicia 58 may be positioned approximately 90.0 centimeters and 120.0 centimeters above the bottom wall 16. A mirrored surface 60 is positioned on the interior surface 30 of the perimeter wall 18. The mirrored surface 60 may be positioned above the sink indicia 58. Television indicia 62 is positioned on the interior surface 30 of the perimeter wall 18 and is configured to resemble a flat-screened television. Vending machine indicia 64 is positioned on the interior surface 30 of the playhouse 12. More particularly, the vending machine indicia 64 is positioned on the perimeter wall 18 and extends upwardly from a bottom edge 66 of the perimeter wall 18. The vending machine indicia 64 is configured to resemble a vending machine. Flower indicia 68 is positioned on the interior surface 30 of the playhouse 12. In particular, the flower indicia 68 is positioned on the perimeter wall 18 and extends upwardly from the bottom edge 66 of the perimeter wall 18. The flower indicia 68 is configured to resemble a bouquet of flowers positioned within a flower pot and supported by a table.

A plurality of hairstyling implements 70 is provided. The hairstyling implements 70 are sized for positioning within the interior 20 of the playhouse 12. The plurality of hairstyling implements 70 may include a simulated razor 72, a comb 74 and a scissors 76. The simulated razor 72 includes a housing 78 and a simulated blade 80 positioned on a front end 82 of the housing 78. A vibration unit 84 is mounted within the housing 78 and is configured to cause the simulated razor 72 to vibrate. A power supply 86 is coupled to the housing 78. The power supply 86 is electrically coupled to the vibration unit 84 to selectively provide power to the vibration unit 84. The power supply 86 may comprise at least one rechargeable battery. A power actuator 88 is mounted on the housing 78 and is electrically coupled to the vibration unit 84. The power actuator 88 is actuated to an on position to turn on the vibration unit 84 and cause the simulated razor 72 to vibrate. The comb 74 is generally conventional and has a plurality of teeth 90 and a shaft 92. Each of the teeth 90 is coupled to and extends perpendicularly from the shaft 92. The scissors 76 is also conventional and includes a pair of handles 94 coupled to a pair of blades 96. The blades 96 are pivotally coupled together to allow the blades 96 to slide against each other. The blades 96 are dulled and may be constructed from plastic or the like so that the scissors 76 are safe for play by children.

A chair 98 is provided and is sized for positioning within the interior 20 of the playhouse 12. The chair 98 has a bottom portion 100, a leg portion 102 and an upper portion 104. The bottom portion 100 comprises a post 106 and a base 108. The base 108 is coupled to a bottom end 110 of the post 106. The leg portion 102 has a pair of spaced support members 112 and a footrest 114. The footrest 114 is coupled to and extends between a lower end 116 of each of the spaced support members 112. The upper portion 104 includes a seat bottom 118 and a back rest 120 coupled to and extending upwardly from the seat bottom 118. Arm rests 122 may be provided and positioned adjacent to the seat bottom 118. A bench 124 is also positionable within the interior 20 of the playhouse 12. The bench 124 has a seating panel 126 and a plurality of legs 128 coupled to and extending downwardly from the seating panel 126. A back rest 130 may be coupled to and extend upwardly from a rear edge 132 of the seating panel 126.

A plurality of protective garments 134 is configured for positioning within the interior 20 of the playhouse 12. The protective garments 134 may include an apron 136 and a hairstyling cape 138 that are both generally conventional. The apron 136 has a main body 140 and a strap 142. The strap 142 has a first end 144 coupled to a first side 146 of the main body 140 and a second end 148 coupled to a second side 150 of the main body 140. The strap 142 has a break therein defining a pair of strap sections 152. An aperture 154 is positioned in the apron 136 proximate a top end 156 of the main body 140. The hairstyling cape 138 has an opening 158 positioned therein.

In use, as stated above and shown in the Figures, the playhouse 12 is opened via the hinge 33 to provide access to the interior 20. The chair 98, the protective garments 134, the bench 124, and the hairstyling implements 70 are all positioned within the interior 20. Children may then play with the assembly 10 in such a manner that a first child may be seated on the chair 98, while a second child uses the hairstyling implements 70 to pretend to cut and style the hair of the first child. The children can wear the protective garments 134 to further simulate a realistic barber shop environment. Additional children can sit on the bench 124 while waiting for a seat in the chair 98.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A toy barber shop assembly comprising:

a playhouse having a top wall, a bottom wall and a perimeter wall coupled to and extending between said top wall and said bottom wall, each of said top wall, said bottom wall and said perimeter wall defining an interior of said playhouse;

at least one hairstyling implement, said hairstyling implement being sized for positioning within said interior of said playhouse; and a chair, said chair being sized for positioning within said interior of said playhouse;

a roof coupled to an exterior surface of said top wall, said roof including a front panel, a back panel and a pair of side panels coupled to and extending between said front and back panels, each of said side panels sharing an apex and slanting downwardly and outwardly therefrom, said roof being transparent;

sink indicia positioned on an interior surface of said playhouse, said sink indicia being positioned on said perimeter wall, said sink indicia being configured to resemble a salon sink; and a mirrored surface positioned on said interior surface of said perimeter wall, said mirrored surface being positioned above said sink indicia.

2. The assembly of claim 1, further comprising said roof being spaced inwardly from a perimeter edge of said top wall.

3. The assembly of claim 1, further comprising a bench being positionable within said interior of said playhouse.

4. The assembly of claim 1, further comprising said hairstyling implement comprising a simulated razor having a housing and a simulated blade, said simulated blade being positioned on a front end of said housing.

5. The assembly of claim 4, further comprising a vibration unit mounted within said housing, said vibration unit being configured to cause said simulated razor to vibrate.

6. The assembly of claim 5, further comprising a power supply being coupled to said housing, said power supply being electrically coupled to said vibration unit to selectively provide power to said vibration unit.

7. The assembly of claim 5, further comprising a power actuator being mounted on said housing and being electrically coupled to said vibration unit, said power actuator being actuated to an on position to turn on said vibration unit and cause said simulated razor to vibrate.

8. The assembly of claim 1, further comprising said hairstyling implement comprising a comb, said comb having a plurality of teeth and a shaft, each of said teeth being coupled to and extending perpendicularly from said shaft.

9. The assembly of claim 1, further comprising said hairstyling implement comprising a scissors, said scissors having a pair of handles coupled to a pair of blades, said blades being pivotally coupled together to allow said blades to slide against each other.

10. The assembly of claim 1, further comprising a protective garment configured for positioning within said interior of said playhouse, said protective garment comprising a hairstyling cape having an opening positioned therein.

11. The assembly of claim 1, further comprising a protective garment configured for positioning within said interior of said playhouse, said protective garment comprising an apron having a main body and a strap, said strap having a first end coupled to a first side of said main body and a second end coupled to a second side of said main body, said strap having a break therein defining a pair of strap sections.

12. The assembly of claim 1, further comprising pole indicia positioned on an exterior surface of said playhouse, said pole indicia being configured to resemble a barber pole having a staff with a helix of stripes positioned thereon.

13. The assembly of claim 1, further comprising door indicia positioned on an exterior surface of said playhouse, said door indicia being positioned on said perimeter wall of said playhouse, said door indicia being configured to resemble a door.

14. The assembly of claim 1, further comprising a plurality of window indicia positioned on said perimeter wall of said playhouse, each of said window indicia being configured to resemble a window.

15. The assembly of claim 1, further comprising vending machine indicia positioned on an interior surface of said playhouse, said vending machine indicia being positioned on said perimeter wall and extending upwardly from a bottom edge of said perimeter wall, said vending machine indicia being configured to resemble a vending machine.

16. The assembly of claim 1, further comprising a hinge coupled to said playhouse, said hinge being selectively pivotable to provide access to said interior of said playhouse.

17. A toy barber shop assembly comprising:

a playhouse having a top wall, a bottom wall and a perimeter wall coupled to and extending between said top wall and said bottom wall, each of said top wall, said bottom wall and said perimeter wall defining an interior of said playhouse, said perimeter wall including a front wall, a rear wall, a first side wall and a second side wall, said playhouse having an interior surface opposite an exterior surface;

a hinge coupled to said playhouse, said hinge being selectively pivotable to provide access to said interior of said playhouse;

a roof coupled to said exterior surface of said top wall, said roof including a front panel, a back panel and a pair of side panels coupled to and extending between said front and back panels, each of said side panels sharing an apex and slanting downwardly and outwardly therefrom, said roof being spaced inwardly from a perimeter edge of said top wall, said roof being transparent;

pole indicia positioned on said exterior surface of said playhouse, said pole indicia being configured to resemble a barber pole having a staff with a helix of stripes positioned thereon;

door indicia positioned on said exterior surface of said playhouse, said door indicia being positioned on said perimeter wall of said playhouse, said door indicia being configured to resemble a door;

a plurality of window indicia positioned on said perimeter wall of said playhouse, said window indicia being positioned on each of said interior surface and said exterior surface of said playhouse, each of said window indicia being configured to resemble a window;

letter indicia positioned on said exterior surface of said playhouse;

sink indicia positioned on said interior surface of said playhouse, said sink indicia being positioned on said perimeter wall, said sink indicia being configured to resemble a salon sink;

a mirrored surface positioned on said interior surface of said perimeter wall, said mirrored surface being positioned above said sink indicia;

television indicia positioned on said interior surface of said perimeter wall, said television indicia being configured to resemble a flat-screened television;

vending machine indicia positioned on said interior surface of said playhouse, said vending machine indicia being positioned on said perimeter wall and extending upwardly from a bottom edge of said perimeter wall, said vending machine indicia being configured to resemble a vending machine;

flower indicia positioned on said interior surface of said playhouse, said flower indicia being positioned on said perimeter wall and extending upwardly from said bottom edge of said perimeter wall, said flower indicia being configured to resemble a bouquet of flowers positioned within a flower pot and supported by a table;

a bench positionable within said interior of said playhouse, said bench having a seating panel, a back rest and a plurality of legs, each of said legs being coupled to and extending downwardly from said seating panel, said back rest being coupled to and extending upwardly from a rear edge of said seating panel;

a plurality of hairstyling implements, said hairstyling implements being sized for positioning within said interior of said playhouse, said plurality of hairstyling implements including;

a simulated razor, said simulated razor including a housing, a simulated blade, a vibration unit, a power supply and a power actuator, said simulated blade being positioned on a front end of said housing, said vibration unit being mounted within said housing and being configured to cause said simulated razor to vibrate, said power supply being coupled to said housing, said power supply being electrically coupled to said vibration unit to selectively provide power to said vibration unit, said power supply comprising at least one rechargeable battery, said power actuator being mounted on said housing and being electrically coupled to said vibration unit, said power actuator being actuated to an on position to turn on said vibration unit and cause said simulated razor to vibrate;

a comb, said comb having a plurality of teeth and a shaft, each of said teeth being coupled to and extending perpendicularly from said shaft; and a scissors, said scissors having a pair of handles coupled to a pair of blades, said blades being pivotally coupled together to allow said blades to slide against each other;

a chair, said chair being sized for positioning within said interior of said playhouse, said chair having a bottom portion, a leg portion and an upper portion, said bottom portion comprising a post and a base, said base being coupled to a bottom end of said post, said leg portion having a pair of spaced support members and a footrest, said footrest being coupled to and extending between a lower end of each of said spaced support members, said upper portion including a seat bottom, a back rest and a pair of arm rests, said back rest being coupled to and extending upwardly from said seat bottom, each of said arm rests being positioned adjacent to said seat bottom; and a plurality of protective garments configured for positioning within said interior of said playhouse, said protective garments including;

an apron having a main body, an aperture and a strap, said aperture being positioned proximate a top end of said main body, said strap having a first end coupled to a first side of said main body and a second end coupled to a second side of said main body, said strap having a break therein defining a pair of strap sections; and a hairstyling cape having an opening positioned therein.

* * * * *